US006076989A

United States Patent [19]

Pearce et al.

[11] Patent Number: 6,076,989

[45] **Date of Patent: *Jun. 20, 2000**

[54] CASING BOARD WITH TRANSPARENT COVER

[76] Inventors: Jerry W. Pearce; J. Rockland Proffit, both of P.O. Drawer 1029, Sparta, N.C. 28675

[ * ] Notice: Under 35 U.S.C. 154(b), the term of this patent shall be extended for 346 days.

[21] Appl. No.: 08/571,276

[22] Filed: Dec. 12, 1995

[51] Int. Cl.[7] ..... B42F 3/00

[52] U.S. Cl. ..... 402/70; 281/19.1; 281/22; 281/29

[58] Field of Search ..... 281/16, 18, 19.1, 281/22, 28, 29, 31, 34–38; 402/70

[56] References Cited

U.S. PATENT DOCUMENTS

| | | | |
|---|---|---|---|
| 1,729,518 | 9/1929 | Newman | 281/31 |
| 1,912,710 | 6/1933 | Kennedy | 281/31 |
| 1,963,552 | 6/1934 | Horwitt | 281/31 X |
| 2,318,192 | 5/1943 | Boelema, Jr. | 281/31 |
| 2,641,484 | 6/1953 | Brody . | |
| 2,801,115 | 7/1957 | Federbush et al. | 281/31 |
| 4,377,430 | 3/1983 | Bexley et al. . | |
| 4,629,349 | 12/1986 | Pitts . | |
| 4,696,490 | 9/1987 | Sendor et al. . | |
| 4,743,049 | 5/1988 | Wilberg . | |
| 4,793,477 | 12/1988 | Manning et al. . | |
| 4,893,837 | 1/1990 | Pugliese et al. . | |
| 4,991,767 | 2/1991 | Wyant . | |
| 5,002,447 | 3/1991 | Borel . | |
| 5,004,514 | 4/1991 | Pugliese et al. . | |
| 5,030,027 | 7/1991 | Bachrach et al. | 281/29 X |
| 5,042,841 | 8/1991 | Friedman | 281/29 |
| 5,069,568 | 12/1991 | Acker | 281/29 X |
| 5,087,078 | 2/1992 | Phillips . | |
| 5,160,209 | 11/1992 | Schuessler . | |

*Primary Examiner*—Andrea L. Pitts
*Assistant Examiner*—Monicia Smith Carter
*Attorney, Agent, or Firm*—Kennedy, Covington, Lobdell & Hickman, LLP

[57] ABSTRACT

A casing board for use as an information displaying and storage device, which may be formed into a binder, a storage box or be used as a flat board includes a substrate, an opaque intermediate covering layer affixed to the substrate and a transparent outer layer affixed to at least one of the substrate and the opaque covering layer at predetermined affixation locations to define a pocket intermediate the transparent layer and the opaque layer characterized by folded flaps defining turned-edge corners.

23 Claims, 4 Drawing Sheets

CASING BOARD WITH TRANSPARENT COVER

BACKGROUND OF THE INVENTION

The present invention relates broadly to casing boards for use as information displaying and storage devices and, more particularly, to a casing board for use as an information and storage device having a transparent outer layer attached to a substrate with a turned-edge corner.

Casing boards are used for the formation of ring binders, paper holders, videocassette and other information media storage containers and game boards. A casing board is characterized by a generally flat, usually rectangular substrate covered with vinyl or some other suitable outer covering material. The board may be folded into a book-like configuration to form a binder and walls may be affixed thereto to form the casing board into a box. A casing board thus folded defines inner and outer surfaces and the inner surfaces may be fitted with dedicated arrangements to retain specific information bearing media, such as audiotape cassettes, CDs and videocassettes. The more common usage for a casing board folded in a book-like manner is the classic ring binder for holding loose-leaf paper sheets. There, a ring assembly with selectively actuable split rings is attached to a spine whereby the paper leaves may be held in place with the rings latched in a closed disposition.

Developments with regard to the casing board include the disposition of a transparent outer layer on the covered substrate with at least one portion of the transparent outer layer open to form an access opening whereby individual sheets of indicia bearing members may be inserted and interchanged. The uses for such a device are many and varied. They include videocassette storage boxes, study guides, CD-ROM storage boxes, personal ring binders and other forms of information media storage.

Currently, the construction of such binders is generally satisfactory but leaves room for improvement. Typically, a three-piece substrate is formed with a front leaf, a spine portion, and a back leaf arranged in a linear array. An opaque vinyl cover is applied as the primary cover to the substrate and a transparent vinyl cover is applied on the outer surface with the edges and the interstices between the substrates being joined by RF welding. This technique has become the industry standard. The RF welding technique requires shielding and the three-piece substrate because the welding cannot be accomplished through the chipboard substrate. Further, the RF weld technique has an inherent dwell time of three seconds wherein the product must be in contact with the welding mechanism for the three seconds which slows manufacture. As may be appreciated by those skilled in the art, such binders are manufactured on a traveling assembly line and the dwell time of three seconds can accumulate due to the number of binders produced at once.

Another problem associated with the vinyl is its tendency to expand and contract with temperature. The vinyl expands and strains the RF welds and in turn becomes wrinkled, an occurrence which is aggravated by the cooling process. Eventually, the vinyl transparent covers become unsightly due to the temperature responsiveness of the material. Further problems occur when printing on the information bearing members which must come into contact with the transparent vinyl. When the vinyl comes into contact with typical printed material, it tends to pick up the print and produce an image, known as an "offset image," on the transparent vinyl material. This becomes unsightly when the indicia bearing member is to be changed and the print can stick to the transparent vinyl which makes the indicia bearing member difficult to remove, and, once removed, any remaining printed matter on the transparent cover can interfere with newly inserted indicia bearing members.

Finally, the RF weld technique results in a characteristic weld bead around the perimeter of the casing board which presents a less-than-neat appearance and can be sharp, thus presenting a personnel hazard. Finally, once the useful life of the vinyl casing board has passed, the vinyl is not susceptible to current recycling techniques.

In the area of ring binders, the ring latch assembly must be attached to the vinyl substrate with rivets, thus preventing the use of the spine portion as a pocketed portion for receiving individual indicia bearing members.

Therefore, there exists a need in the industry for an improved transparently sleeved casing board.

SUMMARY OF THE INVENTION

It is accordingly an object of the present invention to provide a casing board for use as an information displaying and storage device having a transparent outer cover which addresses the aforesaid problems.

It is therefore an object of the present invention to provide a casing board which can be used as a binder or other information media storage device having a transparent outer cover which is unaffected by temperature and maintains a smooth and neat appearance throughout its life.

It is another object of the present invention to provide such a casing board which has a smooth, neat edge appearance and does not present a personnel hazard.

It is another object of the present invention to provide such a casing board which may be manufactured at a greater rate than prior casing boards.

It is yet another object of the present invention to provide a casing board with a transparent cover which does not acquire the image from an indicia bearing member inserted intermediate the outer transparent cover and the inner opaque cover.

It is further an object of the present invention to provide such a casing board which, when used as a ring binder, provides the spine, integral with the front cover, as an available area for forming a pocket for receipt of an indicia bearing member.

It is further an object of the present invention to provide such a casing board which does not require RF welding for its assembly.

To that end, a casing board for use as an information displaying and storage device according to the preferred embodiment of the present invention includes the substrate having an inner surface and an outer surface and being formed from a rigid paper material and to a generally rectangular configuration. The present invention further includes an opaque intermediate covering layer affixed to the substrate in a covering relation with at least the outer surface thereof and a transparent outer layer formed from flaccid sheet material and affixed to at least one of the substrate and the opaque covering layer at predetermined affixation locations to define a pocket intermediate the transparent layer and the opaque layer with the affixation locations being along at least three edges of the board. The outer layer is formed with at least three transparent flaps formed along at least three edges thereof with the transparent flaps being folded over onto the opaque covering layer and fixed thereto with end portions of each transparent flap overlying end portions of adjacent, perpendicularly oriented transparent flaps with a remainder of the transparent flaps being fixed to at least one of the inner surface of the substrate and the opaque layer with at least one edge of the transparent layer being unaffixed to the board intermediate the covering layer in the transparent layer for forming an access opening for insertion of a sheet-like indicia carrying member into the pocket.

In one preferred embodiment of the present invention, the casing board further includes two parallelly oriented creases extending traversely across the board at a predetermined distance from side edges of the board with the creases forming two hinges and defining two opposed leaves and a spine therebetween for forming the board into a book-like configuration for storage of information bearing members between the leaves. Preferably, the casing board includes a binder ring set mounted to the inner surface of the board along the spine for selective retention of information bearing members selectively attached thereto. Preferably, the outer transparent layer is fixed to the opaque layer along the creases to divide the pocket into three individual pockets, each pocket have an access opening intermediate the transparent layer in the opaque layer with one pocket being formed along the spine and at least one pocket being formed along one of the leaves. It is preferred that the transparent layer be taut against the opaque layer to form a substantially wrinkle-free surface on an outermost region of the board with the transparent layer remaining sufficiently flexible for insertion of the information bearing member into the pocket.

In another embodiment of the present invention, the casing board includes a plurality of opposing wall members mounted to an inner surface of the board and configured to reside in an abutting relationship when the board is folded into the book-like configuration to form a storage box for internal storage of information bearing members. Preferably, an indicia carrying member is provided for insertion into the pocket and is formed as a title card carrying information relative to the contents of the storage box. Preferably, the transparent layer is formed of polypropylene.

In another embodiment of the present invention, the casing board is formed without creases and is used as a backing for game boards. To that end, the casing board further includes an indicia carrying member formed as a game board having game related matter printed thereon for receipt in the pocket.

In an alternate embodiment of the present invention, the opaque intermediate covering layer is formed with opaque flaps extending along each of the four side edges thereof with the covering layer being fixed to the substrate on at least the inner surface thereof with the opaque flaps folded over onto the inner surface of the substrate and fixed thereto with end portions of each opaque flap overlying end portions of adjacent, perpendicularly oriented opaque flaps and fixed thereto at a juxtaposition of opaque flaps with a remainder of the opaque flaps being fixed to the inner surface of the substrate. Further, the transparent outer layer includes transparent flaps which are folded over onto the opaque flaps and fixed thereto with end portions of each transparent flap overlying end portions of adjacent, perpendicularly oriented transparent flaps with the remainder of the transparent flaps being fixed to at least one of the inner surface of the substrate and the opaque flaps with at least one edge of the transparent layer being unaffixed to the board intermediate the covering layer and the transparent layer for forming an access opening for insertion of a sheet-like indicia carrying member at the pocket.

The use of the flaps provides a turned-edge construction and the distinction between the basic embodiments of the present invention lies in the turned-edge portion. In the first embodiment of the present invention, the transparent outer layer has a turned-edge construction while the intermediate covering layer does not. In the alternate embodiment, both the opaque intermediate covering layer and the transparent outer layer are formed with the turned-edge construction. This provides a neat appearance and eliminates the need for RF welding. By the above, the present invention provides a casing board which is versatile in its usage, neat in appearance and simple and rapid to manufacture as conpared with the prior art.

DETAILED DESCRIPTION OF THE PREFERRED EMBODIMENT

Figure 1:
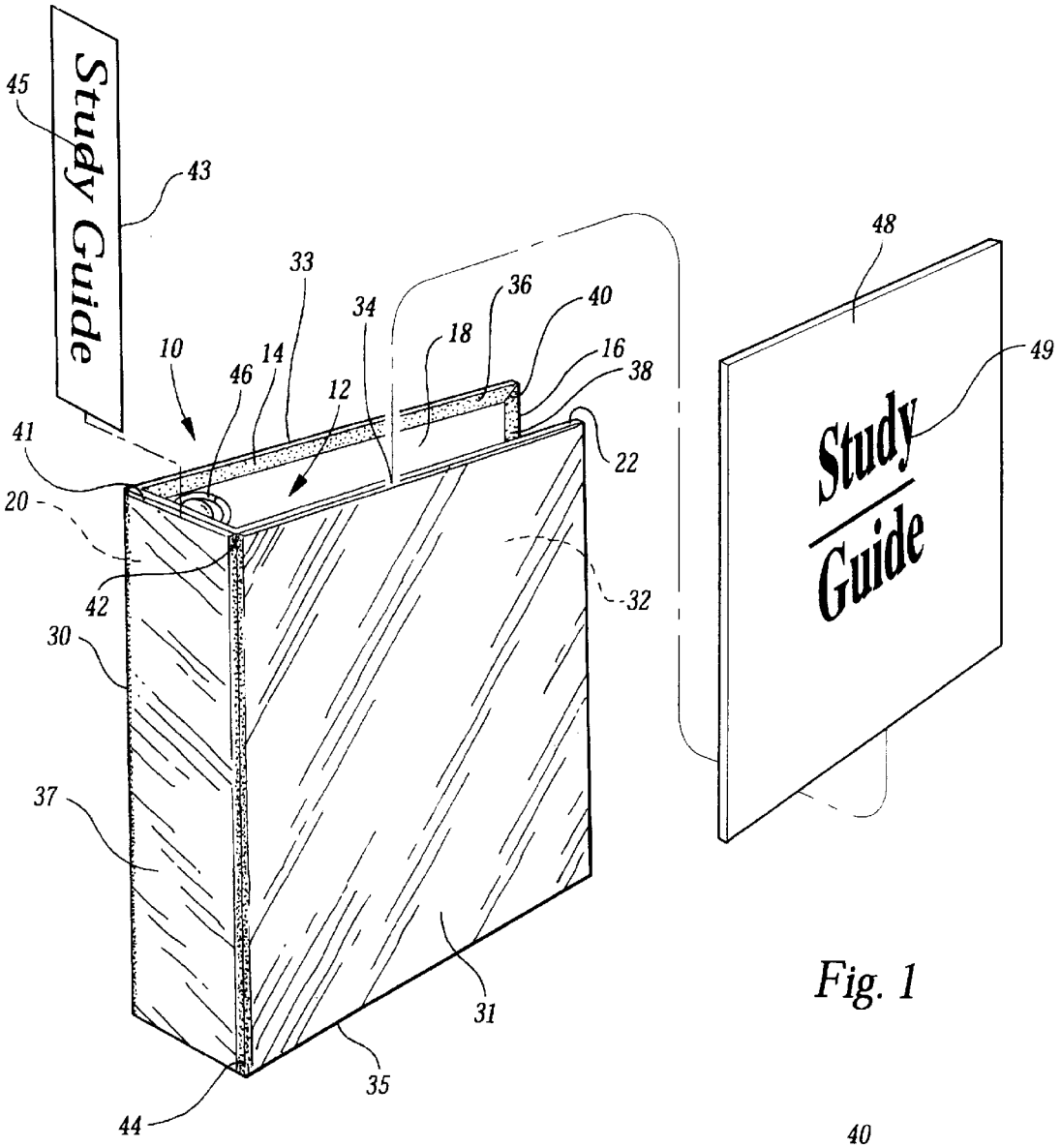
FIG. 1 is a rear perspective view of a casing board folded into a binder according to one preferred embodiment of the present invention.

Turning now to the drawings and, more particularly, to FIG. 1, a casing board for use as an information displaying and storage device is illustrated generally at 10 and includes a substrate 12, which is formed from a single piece of rigid paper material formed into a rectangle having side edges 14,16 and an inner surface 18 and an outer surface 20. The substrate 12 is covered with an intermediate opaque layer 22 which may be formed from polypropylene, paper or any of a number of materials, all of which have the commonality that they are flexible and acceptive of an adhesive bond with paperboard such as that which forms the substrate 12. Typically, the intermediate layer 22 will be thoroughly adhered to the substrate 12. An outer, transparent layer 31 is fitted to the board 10 over both the substrate 12 and the intermediate layer 22. The transparent layer 31 is sealed around the perimeter of the board 10 except for an area along a top edge 14 to form an access opening 34 with the space between the opaque layer 22 and the transparent layer 31 forming a pocket 32 which extends across selective regions of the board 10 as will be seen in greater detail hereinafter. The casing board 10 thusly formed provides the basis for several optional constructions as will be seen in greater detail hereinafter.

One of the defining characteristics of the casing board 10 according to the present invention, and the aspect which provides the neat appearance over the prior RF welded versions, is the turned-edge construction appearing at the corners defining the intersection of the edges 14,16. The present invention provides two preferred versions, one version having only the transparent layer formed with a turned-edge construction and the other version having both the transparent layer 31 and the intermediate opaque layer 22 formed with the turned-edge construction. Both versions will be discussed in greater detail hereinafter.

Figure 2:
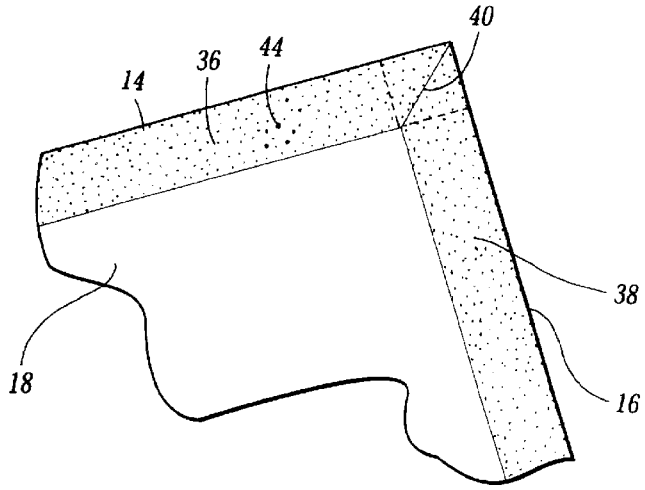
FIG. 2 is a partial plan view of an internal corner of the casing board illustrated in FIG. 1 depicting the turned-edge corner construction.

The first version, with only the turned-edge construction applied to the transparent layer 31, is illustrated in FIGS. 1 and 2. With particular reference to FIG. 2, it can be seen that the transparent layer 31 is formed as a generally rectangular member with outwardly projecting flaps 36,38 formed along the edges thereof. In order to form the turned-edge construction, one flap 38 is folded over onto the opaque layer 22 and substrate 12 and is adhered thereto using any suitable adhesive 44. The other flap 36 is then folded over onto the intermediate opaque layer 22 and substrate 12 with a portion of the last folded flap 36 extending across a portion of the first folded flap 38 with the remainder of the flaps 36 extending along the inner surface 18 of the substrate 12. It should be understood that the presence or absence of the intermediate opaque layer 22 does not affect the turned-edge construction applied to the transparent layer 31.

Figure 3:
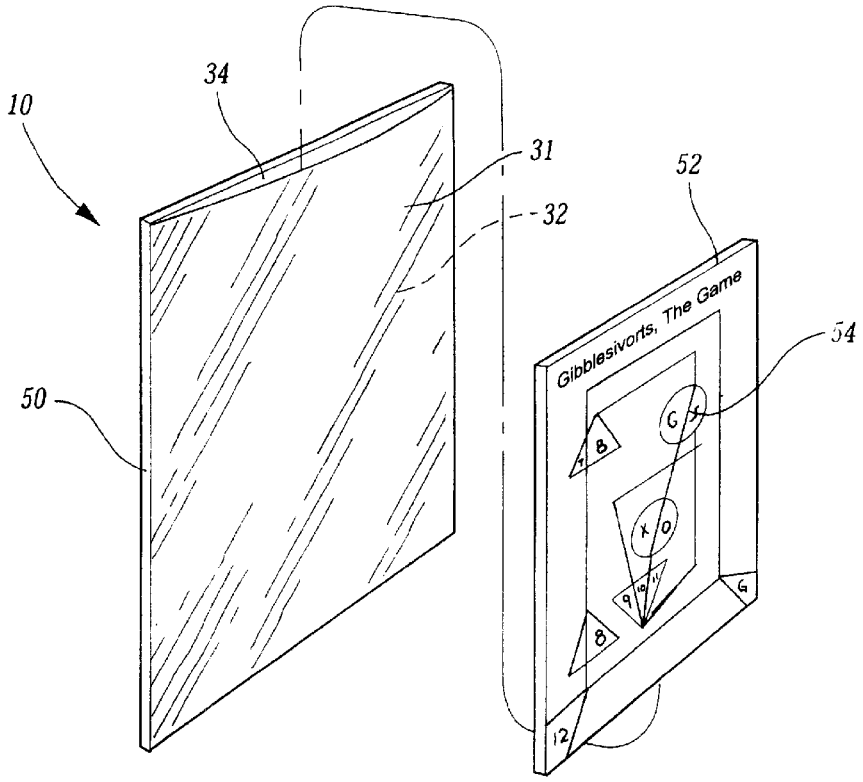
FIG. 3 is a perspective view of a casing board according to the preferred embodiment of the present invention illustrating its use as a backing for a game board.
Figure 4:
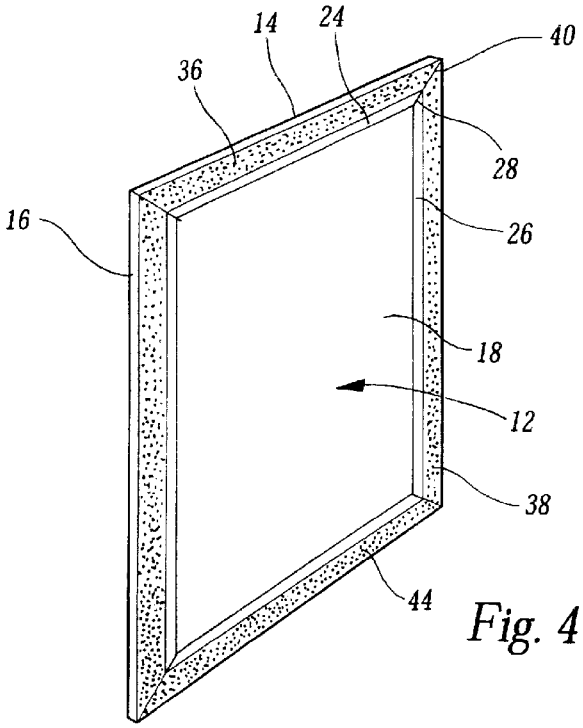
FIG. 4 is a rear view of the casing board illustrated in FIG. 3.
Figure 5:
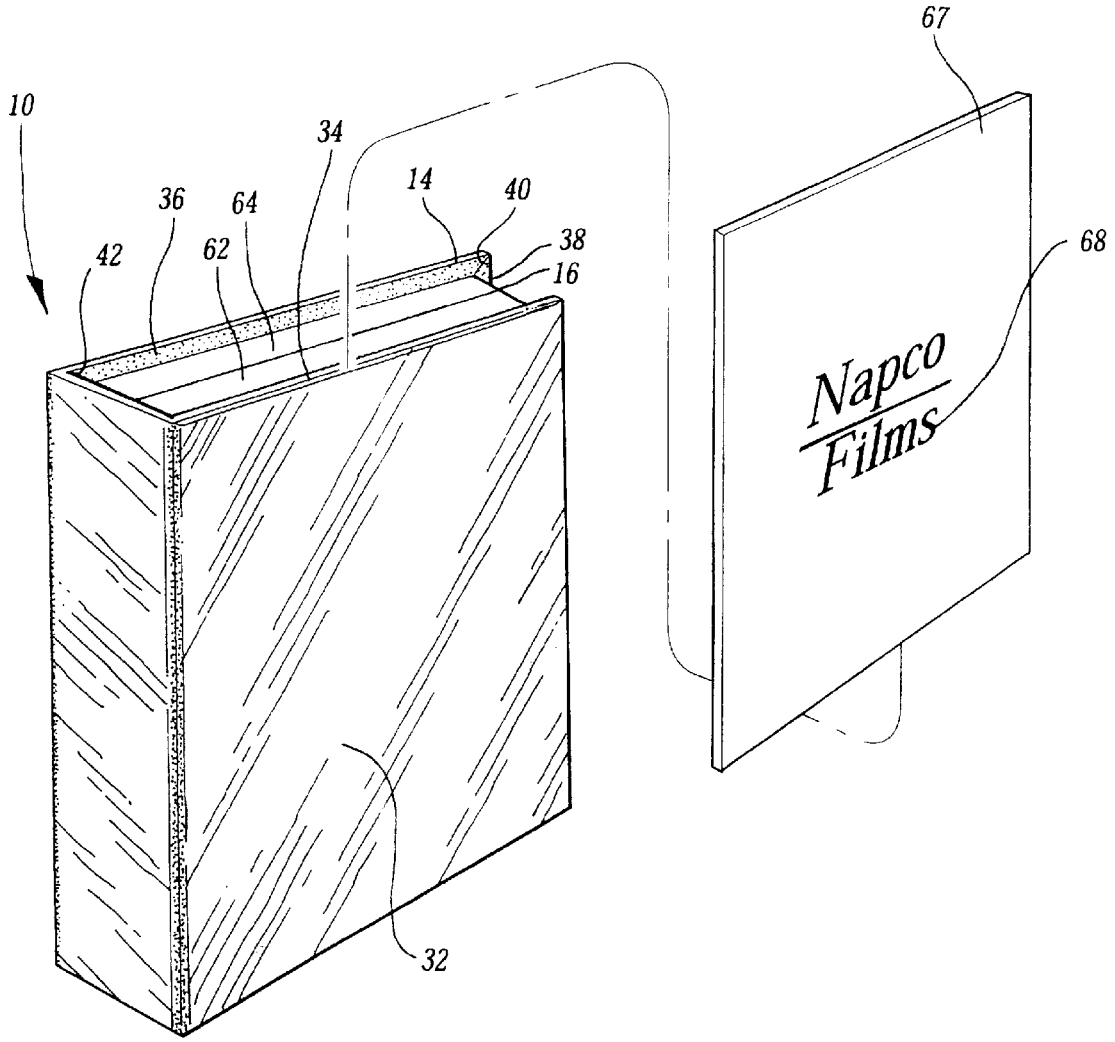
FIG. 5 is a perspective view of the casing board of the present invention configured for use as a videocassette storage box.

The second turned-edge construction is illustrated generally in FIGS. 3 and 4. With particular reference to FIG. 4, it can be seen that the intermediate opaque layer 22 is formed as a generally rectangular member with outwardly projecting integrally formed flaps 24,26 which are folded over onto the substrate 12 and adhered thereto in a manner similar to the above-described transparent layer. Once the intermediate opaque layer 22 is formed with its turned-edge construction, the transparent layer 31 may be formed the same way over the intermediate opaque layer 22. Optionally, the turned-edge construction may be combined wherein the intermediate opaque layer 22 and its associated flaps 24,26 are joined to the transparent layer 31 and its associated flaps 36,38 to form the dual turned-edge construction comprising a turned edge 28 associated with the intermediate layer 22 and another turned edge 40 associated with the transparent layer 31. All of the above-described constructions are equally inclusive of the features associated with the present invention and the choice is mainly up to the product designer based on end use requirements.

Regarding the manufacturing of the product, known techniques may be employed to apply covering material from rolls to traveling substrate members in an on-going, assembly line-type operation. Basically, heat activated glue is applied to the wrap material, be it the opaque intermediate layer 22 or the transparent layer 31. Particularly, the glue is applied substantially to the entire surface of the opaque intermediate layer 22 for complete adhesion to the substrate 12. The glue is applied to the outer surface of the intermediate opaque layer 22 only in areas where the transparent layer is to be sealed. Then, a roll of the clear polypropylene material which forms the outer transparent layer 31 is fed across a hot roller at a temperature of approximately 300° F. in conjunction with the pattern-glued substrate 12 and opaque layer 22 combination. The heat then seals the two materials together where the board 10 is taken to a case maker for casing and lining operations which are optional. Once the adhesive is applied and the three layers 12,22,31 are fixed together, the turned-edge construction can proceed in a manner described above. It will be appreciated by those skilled in the art that there are several techniques available for manufacturing the casing board according to the preferred embodiments of the present invention discussed herein. It should be noted that the present invention is not to be limited by any one particular manufacturing technique and the features of the present invention may be realized by those skilled in the art using various manufacturing techniques.

The casing board 10 of the present invention is particularly suited for several different applications as seen in the accompanying drawings. As previously discussed, it should be noted that each of the applications is equally suitable to either the single turned-edge construction as illustrated in FIGS. 1 and 2 and discussed above or the dual turned-edge construction as illustrated in FIGS. 3 and 4 and also discussed above.

Initially, the casing board 10 may be formed into a binder 30 as illustrated in FIG. 1. To that end, the board 10 is divided into three distinct portions by the formation of traversely extending creases 42 which form two leaves 33,35 of similar dimension with a narrower spine 37 extending therebetween. The leaves 33,35 are folded away from the spine 37 to form a book-like structure defining the binder 30. As can be seen in FIG. 1, the transparent layer 31 is adhered to the intermediate layer 22 along a narrow extent adjacent the creases 42 forming a front pocket 32 having the previously discussed access opening 34 and a spine pocket 41 having a spine pocket access opening 39. Accordingly, an indicia carrying member 48 formed as a generally rigid sheet bearing indicia 49 may be inserted in the front pocket 32 through the access opening 34 to indicate the contents or subject matter associated with the binder 30. Additionally, a spine indicia carrying member 43 having indicia 45 formed thereon may be disposed in the spine pocket 41 through the aforesaid spine pocket access opening 39.

In order to retain paper or other information bearing members within the binder 30, a conventional locking binder ring set 46 is mounted to the inner surface 18 of the board 10 along the spine 37. In order to use the spine pocket 41, the binder ring set 46 must be attached to the inner surface 18 of the spine 37 without rivets which pass through the board 10 and appear on the outer surface of the board 10. This would render the spine pocket 37 useless. Accordingly, the binder ring set 46 should be attached to the inner surface 18 of the spine 37 using a fastener assembly for concealably fastening a paper retaining mechanism to a binder. Such an assembly is disclosed in Schuessler U.S. Pat. No. 5,160,209. A thorough discussion of this technique is beyond the scope of the present discussion yet the aforesaid Schuessler reference provides the necessary information in that regard. As will be discussed in greater detail hereinafter, it should be noted that the spine pocket 37 and front pocket 32 may be combined into a single pocket by elimination of the adhesive 44 extending along the crease 42.

Turning now to FIGS. 3 and 4, a second use for the casing board 10 of the present invention is disclosed. There, no creases are formed in the board 10 and its use is for a game board or other flat sheet display. As seen in FIG. 3, the game board 52 having game related indicia 54 printed thereon may be fitted into the planar pocket 32 with the polypropylene transparent cover 31 forming a protective surface for board game play. Optionally, the game board version 50 may be used as a display for photographs or other planar informational display.

There, the board 10 is fitted with a plurality of generally U-shaped walls 62,64 which may be formed of plastic as is the norm. The walls 62,64 are configured for abutment when the casing board 10 is folded onto the leaf and spine binder configuration. Internally, and as will be appreciated by those skilled in the art, a variety of molded plastic members may be used as inserts for retention of videocassettes, compact discs, cassette tapes or other information bearing media. A title card 67 is provided having title information 68 printed thereon for insertion into the front pocket 32 through the access opening 34, and, as may be appreciated, an optional spine indicia carrying member (not shown) may be used in a manner as illustrated in FIG. 1.

Figure 6:
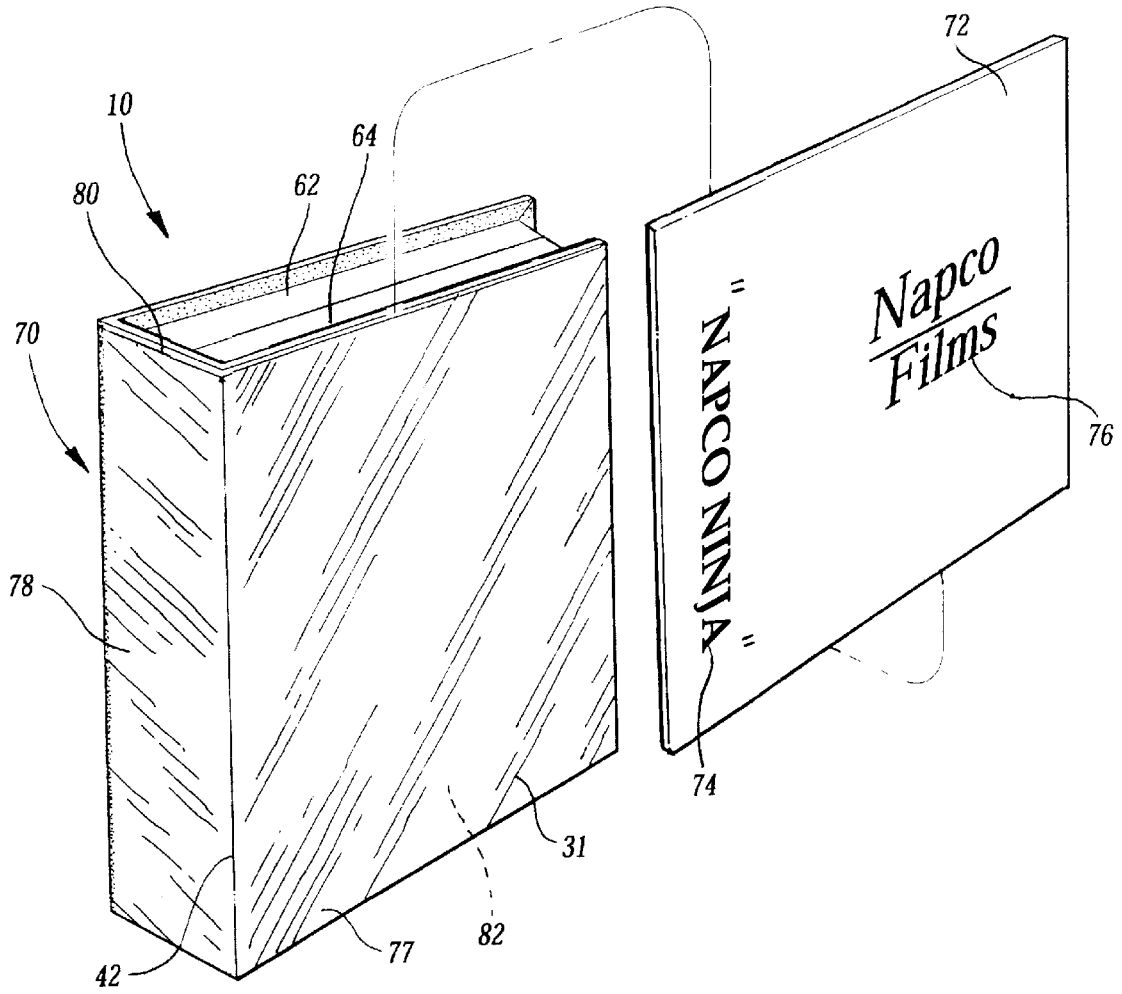
FIG. 6 is a perspective view of a variation of the storage box configuration shown in FIG. 5 and illustrating the extended pocket.

Another version of the present invention is illustrated in FIG. 6. There, the casing board 10 is formed into a storage box 70 and the transparent layer 31 remains unadhered along the crease 42 this defines an elongate pocket 82 extending across a front leaf 77 and a spine 78. The elongate indicia bearing member 72 includes front indicia 76 and spine indicia 74 and may be inserted through the elongate access opening 80 to provide the convenience of a single title card associated with the storage box 70 of the present invention. It will also be appreciated that the elongate indicia carrying member 72 may be equally applied to the binder 30 and any of the other folded versions of the casing board.

By the above, the present invention provides a casing board of unique and versatile construction. Due to the ability of the polypropylene to withstand temperature changes, the transparent layer 31 is drawn taut across the substrate 12 and remains so throughout its useful life. Further, due to the elimination of the RF welding techniques the present invention provides a substantially increased production rate. In addition, the use of a single substrate combined with the aforesaid concealable fastening assembly provides a casing board which may be formed into a binder of a uniquely neat appearance. This appearance coupled with the turned-edge construction and the optional elongate indicia bearing members provides a versatile casing board capable of many uses.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A casing board for use as an information displaying and storage device, said casing board comprising:

a substrate having an inner surface and an outer surface and being formed from a rigid paper material into a generally rectangular configuration;

an opaque intermediate covering layer affixed to said substrate in a covering relation with at least said outer surface thereof; and a transparent outer layer formed from flaccid sheet material and affixed to at least one of said substrate and said opaque covering layer at predetermined affixation locations to define a pocket intermediate said transparent layer and said opaque layer, said affixation locations being along at least three edges of said board, said outer layer being formed with at least three transparent flaps formed along at least three edges thereof, said transparent flaps being folded over onto said opaque covering layer and fixed thereto with end portions of each said transparent flap overlying end portions of adjacent, perpendicularly oriented transparent flaps with a remainder of said transparent flaps being fixed to at least one of said inner surface of said substrate and said opaque covering layer with at least one edge of said transparent layer being unaffixed to said board intermediate said covering layer and said transparent layer for forming an access opening for insertion of a sheet-like indicia carrying member into said pocket.

2. A casing board for use as an information displaying and storage device according to claim 1 and further comprising two parallelly oriented creases extending traversely across said board at a predetermined distance from side edges of said board, said creases forming two hinges and defining two opposed leaves and a spine therebetween for forming said board into a book-like configuration for storage of information bearing members between said leaves.

3. A casing board for use as an information displaying and storage device according to claim 2 and further comprising a binder ring set mounted to said inner surface of said board along said spine for selective retention of information bearing members selectively attached thereto.

4. A casing board for use as an information displaying and storage device according to claim 2 wherein said outer transparent layer is fixed to said opaque layer along said creases to divide said pocket into three individual pockets, each pocket having an access opening intermediate said transparent layer and said opaque layer with one said pocket being formed along said spine and at least one said pocket being formed along one of said leaves.

5. A casing board for use as an information displaying and storage device according to claim 4 and further comprising a binder ring set mounted to said inner surface of said board along said spine for selective retention of information bearing members selectively attached thereto.

6. A casing board for use as an information displaying and storage device according to claim 2 wherein said pocket extends across said crease to define a single pocket extending along at least one of said leaves and said spine for receipt of an indicia bearing member having information extending over an area extending beyond the area of one of said leaves.

7. A casing board for use as an information displaying and storage device according to claim 6 and further comprising an indicia carrying member formed to extend across at least one said leaf and said spine when inserted into said pocket.

8. A casing board for use as an information displaying and storage device according to claim 1 wherein said transparent layer is taut against said opaque layer to form a substantially wrinkle-free surface on an outermost region of said board, with said transparent layer remaining sufficiently flexible for insertion of said indicia carrying member into said pocket.

9. A casing board for use as an information displaying and storage device according to claim 2 and further comprising a plurality of opposing wall members mounted to an inner surface of said board and configured to reside in an abutting relationship when said board is folded into said book-like configuration to form a storage box for internal storage of information bearing members.

10. A casing board for use as an information displaying and storage device according to claim 9 and further comprising an indicia carrying member formed as a title card bearing information relative to the contents of said storage box for receipt in said pocket.

11. A casing board for use as an information displaying and storage device according to claim 1 wherein said transparent layer is formed of polypropylene.

12. A casing board for use as an information displaying and storage device according to claim 1 and further comprising an indicia carrying member formed as a game board having game related matter printed thereon for receipt in said pocket.

13. A casing board for use as an information displaying and storage device, said casing board comprising:

a substrate having an inner surface and an outer surface and being formed from a rigid paper material into a generally rectangular configuration;

an opaque intermediate covering layer affixed to said substrate in a covering relation with said outer surface thereof, said covering layer being formed with opaque flaps extending along each of four side edges thereof, said covering layer being fixed to said substrate on at least said inner surface thereof, with said opaque flaps folded over onto said inner surface of said substrate and fixed thereto with end portions of each said opaque flap overlying end portions of adjacent, perpendicularly oriented opaque flaps and fixed thereto at a juxtaposition of opaque flaps with a remainder of said opaque flaps being fixed to said inner surface of said substrate; and a transparent outer layer formed from flaccid sheet material and affixed to at least one of said substrate and said opaque covering layer at predetermined affixation locations to define a pocket intermediate said transparent layer and said opaque layer, said affixation locations being along at least three edges of said board, said outer layer being formed with at least three transparent flaps formed along at least three edges thereof, said transparent flaps being folded over onto said opaque flaps and fixed thereto with end portions of each said transparent flap overlying end portions of adjacent, perpendicularly oriented transparent flaps with a remainder of said transparent flaps being fixed to at least one of said inner surface of said substrate and said opaque flaps with at least one edge of said transparent layer being unaffixed to said board intermediate said covering layer and said transparent layer for forming an access opening for insertion of a sheet-like indicia carrying member into said pocket.

14. A casing board for use as an information displaying and storage device according to claim 13 and further comprising two parallelly oriented creases extending traversely across said board at a predetermined distance from side edges of said board, said creases forming two hinges and defining two opposed leaves and a spine therebetween for forming said board into a book-like configuration for storage of information bearing members between said leaves.

15. A casing board for use as an information displaying and storage device according to claim 14 and further comprising a binder ring set mounted to said inner surface of said board along said spine for selective retention of information bearing members selectively attached thereto.

16. A casing board for use as an information displaying and storage device according to claim 14 wherein said outer transparent layer is fixed to said opaque layer along said creases to divide said pocket into three individual pockets, each pocket having an access opening intermediate said transparent layer and said opaque layer with one said pocket being formed along said spine and at least one said pocket being formed along one of said leaves.

17. A casing board for use as an information displaying and storage device according to claim 16 and further comprising a binder ring set mounted to said inner surface of said board along said spine for selective retention of information bearing members selectively attached thereto.

18. A casing board for use as an information displaying and storage device according to claim 13 wherein said transparent layer is taut against said opaque layer to form a substantially wrinkle-free surface on an outermost region of said board, with said transparent layer remaining sufficiently flexible for insertion of said indicia carrying member into said pocket.

19. A casing board for use as an information displaying and storage device according to claim 14 and further comprising a plurality of opposing wall members mounted to an inner surface of said board and configured to reside in an abutting relationship when said board is folded into said book-like configuration to form a storage box for internal storage of information bearing members.

20. A casing board for use as an information displaying and storage device according to claim 14 wherein said pocket extends across said crease to define a single pocket extending along at least one of said leaves and said spine for receipt of an indicia carrying member having information extending over an area extending beyond the area of one of said leaves.

21. A casing board for use as an information displaying and storage device according to claim 20 and further comprising an indicia carrying member formed as a title card bearing information relative to the contents of said storage box and configured to extend across at least one said leaf and said spine when inserted into said pocket.

22. A casing board for use as an information displaying and storage device according to claim 13 wherein said transparent layer is formed of polypropylene.

23. A casing board for use as an information displaying and storage device according to claim 13 and further comprising an indicia carrying member formed as a game board having game related matter printed thereon for receipt in said pocket.

* * * * *